US012419487B2

(12) United States Patent
Schultz et al.

(10) Patent No.: US 12,419,487 B2
(45) Date of Patent: Sep. 23, 2025

(54) METHOD FOR OPERATING A WATER-BEARING HOUSEHOLD APPLIANCE AND WATER-BEARING HOUSEHOLD APPLIANCE

(71) Applicants: Reckitt Benckiser (Brands) Limited, Berkshire (GB); BSH Hausgeräte GmbH, Munich (DE)

(72) Inventors: Jakob Schultz, Munich (DE); Alexander Schiele, Munich (DE); Daniel Köhler, Munich (DE); Henry Matthew Lawrence Fletcher, Cambridgeshire (GB); Matthew Burrows, Cambridgeshire (GB); Siddharth Gupta, Cambridgeshire (GB)

(73) Assignees: Reckitt Benckiser (Brands) Limited, Berkshire (GB); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/608,436

(22) PCT Filed: Jun. 8, 2020

(86) PCT No.: PCT/EP2020/065861
§ 371 (c)(1),
(2) Date: Nov. 2, 2021

(87) PCT Pub. No.: WO2020/249520
PCT Pub. Date: Dec. 17, 2020

(65) Prior Publication Data

US 2022/0192460 A1 Jun. 23, 2022

(30) Foreign Application Priority Data

Jun. 11, 2019 (EP) ..... 19179399
Jun. 11, 2019 (GB) ..... 1908310

(51) Int. Cl.
*A47L 15/44* (2006.01)
*A47L 15/00* (2006.01)
(Continued)

(52) U.S. Cl.
CPC ..... *A47L 15/4463* (2013.01); *A47L 15/0055* (2013.01); *D06F 34/14* (2020.02);
(Continued)

(58) Field of Classification Search
CPC ..... A47L 15/4463; A47L 15/0055; A47L 2501/07; A47L 15/4295; A47L 15/4409;
(Continued)

(56) References Cited

U.S. PATENT DOCUMENTS 8,815,018 B2 8/2014 Housmekerides
2007/0143933 A1 6/2007 Potyrailo et al.
(Continued)

FOREIGN PATENT DOCUMENTS

CN 101005789 A 7/2007
CN 101302700 A 11/2008
(Continued)

OTHER PUBLICATIONS

Combined Search and Examination Report for United Kingdom application No. GB190831.04 mailed Nov. 21, 2019.
(Continued)

*Primary Examiner* — Alexander Markoff
(74) *Attorney, Agent, or Firm* — Dunlap Codding, P.C.

(57) ABSTRACT

A method for operating a water-bearing household appliance for treating articles, in particular a dishwasher or washing machine, the water-bearing household appliance including a treatment chamber for treating the articles with a washing liquor and a dosing system for dispensing a dosing-amount of detergent provided by a dosing unit, the method comprising: selecting one of a plurality of different treatment
(Continued)

cycles, controlling the water-bearing household appliance to perform the selected treatment cycle, actuating the dosing system to dispense the dosing-amount of detergent according to the selected treatment cycle, detecting a sensor signal of the dispensed dosing-amount of detergent, adjusting the selected treatment cycle as a function of the detected sensor signal, and controlling the water-bearing household appliance to perform the adjusted treatment cycle.

9 Claims, 3 Drawing Sheets

(51) Int. Cl.

| | |
|---|---|
| ***D06F 34/14*** | (2020.01) |
| ***D06F 39/02*** | (2006.01) |
| *D06F 33/37* | (2020.01) |
| *D06F 103/22* | (2020.01) |

(52) U.S. Cl.
CPC ..... *D06F 39/022* (2013.01); *A47L 2501/07* (2013.01); *D06F 33/37* (2020.02); *D06F 2103/22* (2020.02)

(58) Field of Classification Search
CPC ..... A47L 2401/04; A47L 2401/32; A47L 2501/30; A47L 15/0028; D06F 34/14; D06F 39/022; D06F 33/37; D06F 2103/22; D06F 33/36; D06F 2105/52
See application file for complete search history.

(56) References Cited

U.S. PATENT DOCUMENTS

| | | | | |
|---|---|---|---|---|
| 2016/0143503 | A1* | 5/2016 | Kan | A47L 15/449 134/56 D |
| 2017/0027410 | A1 | 2/2017 | Stoyanov et al. | |
| 2018/0002856 | A1* | 1/2018 | Hombroek | D06F 39/087 |
| 2020/0208331 | A1* | 7/2020 | Biswas | C02F 1/5209 |

FOREIGN PATENT DOCUMENTS

| | | | | |
|---|---|---|---|---|
| CN | 108035119 | A | 5/2018 | |
| DE | 10145601 | A1 | 10/2002 | |
| EP | 1474030 | A1 | 11/2004 | |
| EP | 2141275 | A1 | 1/2010 | |
| EP | 2534996 | A1 | 12/2012 | |
| EP | 2644079 | A1 * | 10/2013 | A47L 15/0055 |
| JP | 2017158946 | A | 9/2017 | |
| WO | 03059143 | A1 | 7/2003 | |
| WO | WO-2018233919 | A1 * | 12/2018 | A47L 15/4291 |
| WO | 2019063971 | A1 | 4/2019 | |

OTHER PUBLICATIONS

English Translation of Office Action for Chinese application No. 202080039590.2 dated May 31, 2023.
International Search Report and Written Opinion dated Apr. 8, 2020, issued in connection with international Application No. PCT/EP2020/065861.
Examination Report dated Mar. 18, 2024, in EP20730082.3, filed Aug. 6, 2020.

* cited by examiner

METHOD FOR OPERATING A WATER-BEARING HOUSEHOLD APPLIANCE AND WATER-BEARING HOUSEHOLD APPLIANCE

CROSS-REFERENCE TO RELATED APPLICATIONS

This application is a U.S. National Phase of International Patent Application No. PCT/EP2020/065861, filed on 8 Jun. 2020, which claims priority to United Kingdom Application Serial No. 1908310.4 filed 11 Jun. 2019 and European Application Serial No. 19179399.1 filed 11 Jun. 2019. The entire contents of these applications are incorporated herein by reference in their entirety.

BACKGROUND

Technical Field

The present invention relates to a method for operating a water-bearing household appliance and a water-bearing household appliance, in particular a dishwasher or washing machine.

Background

Known water-bearing household appliances, such as dishwashers, are implemented to automatically clean dirty articles placed therein. For a good cleaning result, detergents can be added to the washing liquor. There are several different types of detergent available, such as liquids, gels, powders or tablets, which have different properties.

In order to obtain a favorable cleaning result, it is advantageous to know certain parameters of the detergent that is being used, such as the kind of detergent, the amount of detergent added to the washing liquor, and others.

US 2011/0030729 A1 describes detergent module with a sensor that senses and indicates whether the detergent in the module is a solid type or a liquid-type detergent. The indication is used for selecting washing algorithm that is tailored to exploit a cleaning efficiency of the detergent. Further devices are known from DE 100 39 408 A1, DE 101 45 601 A1, EP 1 159 913 A1, US 2011/0146715 A1, WO 2005/122860 A1 and WO 2006/018516 A1.

It is one object of the present invention to provide an improved method for operating a water-bearing household appliance.

BRIEF SUMMARY OF THE INVENTION

In one aspect, the invention provides a method for operating a water-bearing household appliance for treating articles, in particular a dishwasher or washing machine, the water-bearing household appliance including a treatment chamber for treating the articles with a washing liquor and a dosing system for dispensing a dosing-amount of detergent provided by a dosing unit, the method comprising: selecting one of a plurality of different treatment cycles, controlling the water-bearing household appliance to perform the selected treatment cycle, actuating the dosing system to dispense the dosing-amount of detergent according to the selected treatment cycle, detecting a sensor signal of the dispensed dosing-amount of detergent, adjusting the selected treatment cycle as a function of the detected sensor signal, and controlling the water-bearing household appliance to perform the adjusted treatment cycle.

In another aspect, the invention provides a water-bearing household appliance for treating articles, in particular a dishwasher or washing machine, including a treatment chamber for treating the articles with a washing liquor, a dosing system for dispensing a dosing-amount of detergent provided by a dosing unit, a control unit for controlling the water-bearing household appliance to perform a treatment cycle selected from a plurality of different treatment cycles and a sensor unit for detecting a sensor signal of the dosing-amount of detergent dispensed by the dosing system, wherein the control unit is configured to adjust the selected treatment cycle as a function of the detected sensor signal and to control the water-bearing household appliance to perform the adjusted treatment cycle.

These and other objects, features and advantages of the present invention will become more apparent upon reading the following specification in conjunction with the accompanying description, claims and drawings.

BRIEF DESCRIPTION OF THE DRAWINGS

The accompanying Figures, which are incorporated in and constitute a part of this specification, illustrate several aspects described below.

DETAILED DESCRIPTION OF THE INVENTION

Figure 1:
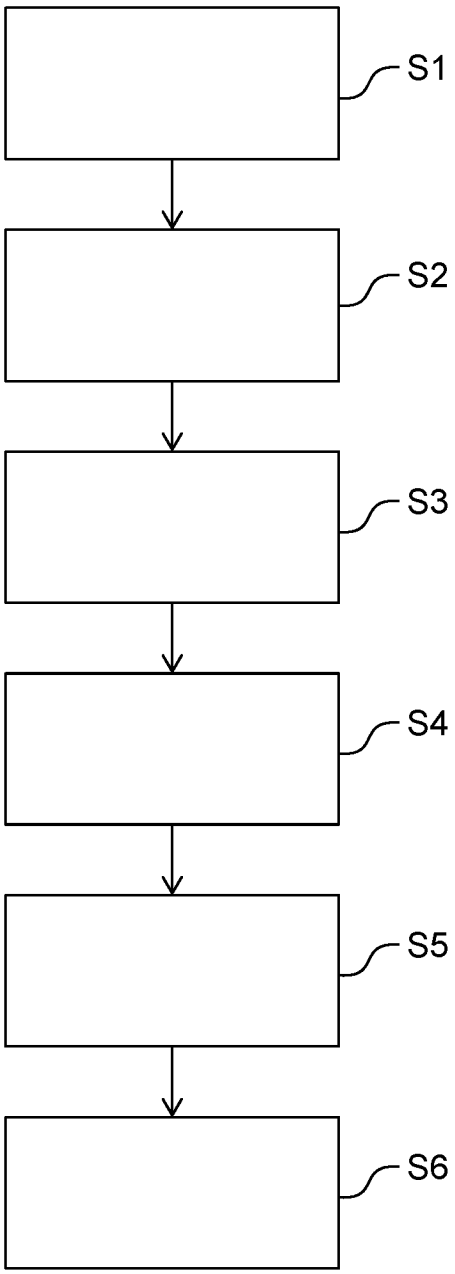
FIG. 1 shows a block diagram of a first example of a method for operating a water-bearing household appliance.

According to a first aspect, a method for operating a water-bearing household appliance for treating articles, in particular a dishwasher or washing machine, is suggested. The water-bearing household appliance includes a treatment chamber for treating the articles with a washing liquor and a dosing system for dispensing a dosing-amount of detergent provided by a dosing unit. In a first step, one of a plurality of different treatment cycles is selected. In a second step, the water-bearing household appliance is controlled to perform the selected treatment cycle. In a third step, the dosing system is actuated to dispense the dosing-amount of detergent according to the selected treatment cycle. In a fourth step, a sensor signal of the dispensed dosing-amount of detergent is detected. In a fifth step, the selected treatment cycle is adjusted as a function of the detected sensor signal, and in a sixth step, the water-bearing household appliance is controlled to perform the adjusted treatment cycle.

This method advantageously allows to control the water-bearing household appliance such that operation of the water-bearing household appliance is more reliable and optimized, in particular optimized with respect to a cleaning efficiency, use of resources such as electric energy, fresh water and chemicals, as well as time needed to finish one treatment cycle. The method is preferably employed for operating a water-bearing household appliance having one or more automatic dosing systems that provide a storage of detergent sufficient for several treatment cycles and are implemented for dispensing a predefined amount of detergent when being actuated.

The water-bearing household appliance preferably has a control unit implemented for controlling it. For example, the control unit comprises a storage unit for storing the plurality of different treatment cycles. The different treatment cycles can be adapted for different scenarios, for example for treating heavily soiled articles, weakly soiled articles, sensitive articles, energy saving and others more. For example, a treatment cycle for treating articles, in particular for washing or cleaning articles, comprises a number of steps that are performed sequentially, such as pre-rinse, cleaning, rinse or drying steps. These steps may be referred to as sub-steps. Each step comprises a certain order of control commands to be performed at certain timings from the start of the treatment cycle or of the step. The control commands may be referred to as parameters of the step. Similar steps in different treatment cycles may have different parameters. For example, the parameters of the cleaning step of a first treatment cycle can be different from the parameters of the cleaning step of a second treatment cycle.

Selecting one treatment cycle from the plurality may be performed by user via a user interface and/or may be performed by the water-bearing household appliance itself. Preferably, the water-bearing household appliance comprises means for detecting a state of the articles to be treated and the control unit is implemented to automatically select the treatment cycle of the plurality of different treatment cycles which is best adapted for achieving an optimum result.

Preferably, each one of the treatment cycles comprises a sub-step with a dispense command, which means that the control unit will actuate the dosing system for dispensing the dosing-amount of detergent provided by the dosing unit. The dosing system will then dispense or release the dosing-amount of detergent into the treatment chamber or a dosing channel or the like. In a preferred embodiment, a dosing channel is arranged between the dosing system and the treatment chamber, through which the dosing-amount of detergent is guided into the treatment chamber, where it is added to the washing liquor. The water-bearing household appliance may comprise specific means for adding the dosing-amount of detergent to the washing liquor, for example a specific mixing chamber to ensure a full and fast dissolution of the detergent in the washing liquor.

The dosing system may be implemented as a dosing system that needs refilling after each treatment cycle. Preferably, the dosing system is implemented as an automatic dosing system implemented for dosing the dosing-amount of detergent from a storage of detergent that comprises several times the dosing-amount of detergent, for example at least 100 times, preferably at least 500 times, the dosing-amount of detergent. For example, the dosing unit comprises the storage of detergent and when the storage is empty, the dosing unit is replaced with a dosing unit having a full storage. The dosing-amount of detergent denotes the part of detergent that is actually dispensed when the dosing system is actuated. The dosing-amount of detergent may be different for different dosing systems and different dispensing steps. For example, the intended dosing-amount of detergent of an automatic dosing system implemented for dosing individual detergent tablets may be one detergent tablet.

The water-bearing household appliance may include more than one dosing system, wherein different dosing systems are preferably employed for different kinds of detergent, such as cleaner, bleach, rinse aid, enzymes and other chemicals that can enhance treating the articles, such as water softeners or the like. The different detergents may be of different consistency.

The detergent may be a fluid, such as a liquid or a gel, a solid, such as powder or tablets, or may be a combination, such as a liquid or gel packed in a foil (liquid capsule).

When the dosing system is actuated to dispense the dosing-amount of detergent, a sensor signal of the dosing-amount of detergent is detected. Preferably, the water-bearing household appliance comprises a sensor unit with a detection unit that is implemented to detect the sensor signal and to output it to the control unit for further processing, for example. Detecting the sensor signal of the dosing-amount of detergent means that a signal that is characteristic of the dosing-amount of detergent is detected. This may be achieved by various techniques and/or means, such as by detecting a capacity change, detecting an optical signal of the dosing-amount of detergent, detecting an acoustic signal of the dosing-amount of detergent and/or detecting a mechanical signal of the dosing-amount of detergent, such as a vibration.

The control unit and/or an analyzing unit are preferably implemented to analyze the detected sensor signal in order to extract information about the dosing-amount of detergent, such as a mass of detergent or a consistency of detergent of the dosing-amount of detergent. Thus, it is possible to obtain an information if the actuation of the dosing system had the intended result, that is, dispensing the intended dosing-amount of detergent, as compared to an erroneous event, in which a wrong amount and/or wrong kind of detergent is dispensed upon actuation.

The control unit is preferably implemented to adjust one or several parameters of the steps of the selected treatment cycle depending on the detected sensor signal. For example, when it is derived from the detected sensor signal that the mass of the dosing-amount of detergent was less than intended according to the particular dispense command of the selected treatment cycle, the dosing system may be actuated once more in order to dispense another dosing-amount of detergent, in case of an automatic dosing system. In case of a dosing system that carries only one charge and needs refilling after each treatment cycle, the temperature of the washing liquor may be increased, if the articles are compatible with a higher temperature, in order to achieve good cleaning results. Further, if it is detected that a wrong kind of detergent was dispensed, operation of the water-bearing household appliance may be stopped in order to prevent damage to the appliance and/or the articles.

Adjusting the selected treatment cycle may further involve setting or adjusting operating parameters of the water-bearing household appliance that can affect the water-bearing household appliance as a whole and all or a number of future treatment cycles that are performed. For example, in a first operation of a brand-new water-bearing household appliance or after replacing or refilling the dosing unit with detergent, a gauging of the dosing system may be performed as a function of the detected sensor signal.

The suggested method has several advantages. Beside being able to optimize the selected treatment cycle as a function of the detected sensor signal, the detected sensor signal may be used to obtain information about the state of the dosing system or a remaining amount of detergent in a storage in case of an automatic dosing system. The state of the dosing system may comprise information about any problems concerning the dosing system. For example, in the case of an automatic dosing system implemented for dosing individual detergent tablets, it may be detected that a detergent tablet was broken when being dispensed. If this is detected several times in a predefined number of dispensing events exceeding a certain threshold, it may be concluded that the dosing mechanism needs servicing.

In an embodiment, the sensor signal of the dispensed dosing-amount of detergent is detected before the detergent is added to the washing liquor.

For example, the dosing-amount of detergent is dispensed from the dosing system into a dosing channel, which leads to the treatment chamber, but is closed at an intermediate position, such that the dosing-amount of detergent may temporarily be stored in the dosing channel. Detection of the sensor signal takes place before or when the dosing-amount of detergent is stored in the dosing channel. This allows to take measures that may improve operation of the water-bearing household appliance as function of the detected sensor signal and before the dosing-amount of detergent is added to the washing liquor.

In a preferred embodiment, detection is carried out by mechanical sensing unit, preferably a piezoelectric sensing unit, an optical sensing unit, an acoustic sensing unit and/or an electrical sensing unit.

The mechanical sensing unit may be configured for detecting mechanical vibrations of coupled elements. Therefore, a strong coupling of the mechanical sensing unit to the element or area where mechanical vibrations are generated by the dosing-amount of detergent is preferred. For example, the mechanical sensing unit is incorporated into a deflecting element on which the dosing-amount of detergent falls after being dispensed and before reaching the washing liquor.

Preferably, the mechanical sensing unit is arranged at a position outside of the treatment chamber, well protected from the harsh climatic conditions inside the treatment chamber. This has the advantage that the mechanical sensing unit has an extended service life and may have a relatively simple construction, and further a hole for guiding a power or signaling cable or the like for the mechanical sensing unit into the treatment chamber can be omitted. Therefore, the treatment chamber is less complex, because sealing means for sealing such hole are not necessary. Further, the mechanical sensing unit may only be pressed onto the coupled element, such that mechanical stresses of the coupled element, for example due to expansion or contraction with temperature changes, are not transferred on the mechanical sensing unit. This further increases service life of the mechanical sensing unit.

An optical sensing unit preferably comprises a light source, such as a laser and/or a light emitting diode, and a light detector, such as a photodiode. The light source and the light detector are arranged in one of several geometries, such that a transmitted light intensity, a reflected light intensity and/or a scattered light intensity of the dosing-amount of detergent is detected. The optical sensing unit may comprise more than one light source and/or light detector arranged in more than one of said geometries. Preferably, the light source is a spectral light source and/or the light detector is a spectral detector. The optical sensing unit may use light at other than visible wavelengths, in particular infrared light.

The acoustic sensing unit may be implemented as an ultrasonic sender-receiver arrangement which may detect a reflected ultrasonic sound intensity and/or a transmitted ultrasonic sound intensity. Further, the acoustic sensing unit may comprise a microphone configured for detecting a noise of the dosing-amount of detergent when hitting an element of the water-bearing household appliance.

The optical and/or acoustic sensing unit may also be implemented as a sensor barrier.

The electrical sensing unit may be implemented as a capacitance detector which detects a change of dielectric permeability of a surrounding volume or an inductive detector which detects a change of magnetic permeability of a surrounding volume.

In a further embodiment, a mass of the detergent of the dosing-amount of detergent, a consistency of the detergent in the dosing-amount of detergent, and/or a chemical composition of the detergent in the dosing-amount of detergent is derived from the detected sensor signal by analyzing the detected sensor signal.

Consistency here means whether the dosing-amount of detergent comprises a liquid, a gel, a powder, a tablet or a liquid capsule. Chemical composition comprises information about the active agents comprised in the detergent, in particular on a molecular level. The mass preferably is the mass in grams of the dosing-amount of detergent.

The information derived in this embodiment is preferably employed for optimizing the selected treatment cycle.

In embodiments, the detected sensor signal is processed by a filtering unit configured for filtering the detected sensor signal in order to remove noise from the detected sensor signal. The filtering unit may be implemented in the sensor unit, an analyzing unit and/or the control unit.

This has the advantage that a signal-to-noise ratio is enhanced and more information about the dosing-amount of detergent may be obtained from the detected sensor signal.

According to a further embodiment, the detected sensor signal and/or an analyzed sensor signal obtained by analyzing the detected sensor signal is compared with a pre-defined expected sensor signal and an error signal is generated as a function of a result of the comparison.

In this embodiment, an information about if dispensing the dosing-amount of detergent took place as intended or as desired may be obtained in a simple way by comparison. Comparing involves, for example, calculating a root-mean-square value (RMS) of the detected sensor signal with respect to the pre-defined expected sensor signal. For example, the detected and the pre-defined expected sensor signal are both a variation of a measurement value, such as an amplitude of a vibration or an intensity of transmitted light, over time. The RMS-value may then be determined with the time as common coordinate. However, a more complicated comparison can be preferred, such as comparing derived values, for example derived by curve analysis of the detected sensor signal. This allows for categorizing the detected sensor signal into one of a plurality of different event categories, such as not enough detergent, partial blocking of the dosing system, bad consistency of the dosing-amount of detergent, or the like.

The error signal may simply be a two-state signal that indicates whether the dosing-amount of detergent was dispensed as expected or if this was not the case. Preferably, it includes certain information of the results of the comparison, such as the event category as described above. Depending on the error signal, certain measures may be suggested or performed automatically, such as an automatic cleaning of the dosing channel or outputting, to a user interface, the information that a storage of the dosing unit is empty and the dosing unit needs to be replaced.

According to a further embodiment, the pre-defined expected signal is a stored signal selected from a plurality of stored signals stored in a signal storage, a calculated signal calculated at a dispense-timing as a function of current operating parameters of the water-bearing household appliance or a determined signal determined from a plurality of historical detected sensor signals.

The stored signals may be generated by a manufacturer of the water-bearing household appliance or the detergent for different kinds of detergent and/or different masses of the dosing-amount of detergent. That is, a catalog of sample signals may be provided, each of which corresponds to a successful dispensing of the respective dosing-amount of detergent.

The calculated signal has the advantage that current operating parameters may be accounted for in the pre-defined expected signal. For example, the calculated signal is obtained by evaluating an equation that describes the expected signal as a function of certain parameters, such as a current temperature, a current humidity, a current load of the treatment chamber with washing liquor and/or with articles, and so on.

The determined signal is determined from a plurality of historical detected sensor signals. For example, the detected sensor signal is stored in a storage unit each time when a dosing-amount of detergent is dispensed and the sensor signal is detected. Current operating parameters may be accounted for as well. The stored sensor signals are then called historical detected sensor signals. During use of the water-bearing household appliance, a large database of historical detected sensor signals will be collected. An algorithm may be implemented that is able to learn from the historical detected sensor signals and extract the pre-defined expected signal by way of prediction. A neural network may be implemented for this task.

The plurality of historical detected sensor signals may further include detected sensor signals that were detected by sensors in a water-bearing household appliance other than the current one. For example, the water-bearing household appliance is connected to a server of the manufacturer and is configured to transmit detected sensor signals to the server. The server then stores the received detected sensor signals from a plurality of connected water-bearing household appliances and may be configured to transmit detected sensor signals from at least one of the plurality to the current water-bearing household appliance. The detected sensor signals to be transmitted may be selected depending on a type or model of the current water-bearing household appliance. Further, historical detected sensor signals may be provided by service personnel, for example as a downloadable file and/or during a firmware update of the control unit of the water-bearing household appliance.

According to a further embodiment, one of a plurality of dosing paths is selected as a function of the detected sensor signal, the analyzed sensor signal and/or the error signal and a setting element is set for routing the dosing-amount of detergent to the selected dosing path.

A dosing path is defined by the path the detergent travels after being dispensed from the dosing system. For example, the dosing channel described before resembles a dosing path that leads to the treatment chamber and the washing liquor. Note that there may be dosing path that does not lead the dosing-amount of detergent to the washing liquor, that is, adding of the dosing-amount of detergent to the washing liquor may be suppressed. A setting element may be considered as a redirecting element, such as a three-way-valve for liquids, that allows to select one of at least two different dosing paths. It is noted that a simple blocking of the dosing channel is considered a dosing path.

This embodiment has the advantage that adding of the dosing-amount of detergent to the washing liquor can be optimized as a function of the parameters of the dosing-amount of detergent, or may be suppressed. This can be useful in cases where the user used a wrong kind of detergent, that might harm or even destroy the articles to be treated.

According to a further embodiment, the method comprises the steps of digitizing the detected sensor signal and processing the digitized sensor signal by means of digital signal processing techniques.

For example, the control unit comprises an analog-digital converter and a means for digital signal processing. This means may be implemented as a dedicated digital-signal processor (DSP), a field programmable gate array (FPGA) or a microprocessor implemented for executing a specific program, or a combination thereof.

Digital signal processing techniques involve arithmetical operations such as fixed-point and floating-point, real-valued and complex-valued, multiplication and addition, in particular FFT (fast-fourier-transform). Preferably, the operations are performed such that a characteristic signature and/or a signal-to-noise ratio are enhanced. Characteristic signature means a certain form of the detected sensor signal that can be characteristic for a dosing-amount of detergent.

According to a further embodiment, the step of adjusting the selected treatment cycle includes stopping the treatment cycle, shutting down the water-bearing household appliance, blocking the dispensed dosing-amount of detergent, selecting a different treatment cycle from the plurality, adjusting one or several parameters of the selected treatment cycle, specifically of a subsequent step of the selected treatment cycle, According to a further embodiment, adjusting one or several parameters of the selected treatment cycle includes adding a dispense command to the selected treatment cycle, adjusting a timing of a dispense command of the selected treatment cycle, adjusting a dosing-amount of detergent of a dispense command, adjusting a temperature profile of the washing liquor over the course of the selected treatment cycle, adjusting a volume of washing liquor of a sub-step of the selected treatment cycle and/or adjusting timings of a transition from a sub-step to a subsequent sub-step of the selected treatment cycle.

According to a further embodiment, the sensor signal is an electrical signal, an optical signal, a mechanical signal, and/or an acoustic signal. Detection of the sensor signal is carried out by a mechanical sensing unit, preferably a piezoelectric sensing unit, an optical sensing unit, an acoustic sensing unit and/or an electrical sensing unit For example, an electrical signal can be obtained by detecting a change of a capacitance or inductivity. An optical signal can be obtained from an arrangement of a light source and a light detector that are arranged such that the dosing-amount of detergent is probed. The optical signal may comprise a transmitted intensity, a reflected intensity and/or a scattered intensity. The mechanical signal comprises a vibration or oscillation of an element that may be induced by an impact of the dosing-amount of detergent after being released from the dosing system. The mechanical signal may be detected by an acceleration sensor or by a piezoelectric sensor. The acoustic signal can be obtained from an arrangement of an ultrasonic sender and an ultrasonic receiver and the acoustic signal may comprise a reflected intensity, a transmitted intensity and/or a modulated intensity. Further, the acoustic signal may be the noise generated by the impact of the dosing-amount of detergent after being released from the dosing system detected by a microphone.

According to a further embodiment, the sensor signal is a mechanical signal that is generated by an impact of the dosing-amount of detergent hitting a deflecting element after being dispensed and before being added to the washing liquor.

This embodiment is advantageous because the deflecting element may be implemented in a way that enhances a signal strength, which makes it easier to detect the sensor signal and analysis of the detected sensor signal is more reliable.

For example, in the case of an automatic dosing system implemented for automatically dosing a detergent tablet having the form of a cylinder, an impact of such tablet in a way that the tablet rolls off is relatively weak, because the momentum is transferred from the translational movement to the rotational movement. For example, a deflecting element having a half-sphere on its surface can effectively prevent such roll-off events.

For this reason, the detection unit is preferably implemented as a piezoelectric sensing unit for sensing the mechanical vibrations generated by the impact. Favorably, the piezoelectric sensing unit has a strong mechanically coupling with the deflecting element, for example it is arranged on a rear side of the deflecting element.

According to a second aspect, a water-bearing household appliance for treating articles, in particular a dishwasher or washing machine, is suggested. The water-bearing household appliance includes a treatment chamber for treating the articles with a washing liquor, a dosing system for dispensing a dosing-amount of detergent provided by a dosing unit, a control unit for controlling the water-bearing household appliance to perform a treatment cycle selected from a plurality of different treatment cycles and a sensor unit for detecting a sensor signal of the dosing-amount of detergent dispensed by the dosing system. The control unit is configured to adjust the selected treatment cycle as a function of the detected sensor signal and to control the water-bearing household appliance to perform the adjusted treatment cycle.

This water-bearing household appliance has the advantage that treatment of the articles can be tuned or optimized as a function of the operation of the dosing system. Preferably, the water-bearing household appliance comprises at least one automatic dosing system that provides a storage of detergent sufficient for several treatment cycles and is implemented for dispensing a predefined amount of detergent when being actuated.

Preferably, the water-bearing household appliance is configured for being operated according to the method according to the first aspect.

The control unit may be implemented in hardware or software. When it is implemented in hardware, the control unit may comprise a computer or microprocessor. When it is implemented in software, the control unit may comprise a computer program product, a function, a routine and/or an application.

According to an embodiment, a detection unit of the sensor unit is arranged such that the sensor signal of the dosing-amount of detergent is detected before the dosing-amount of detergent is added to the washing liquor.

For example, the detection unit is arranged such that the sensor signal is detected at a position along a dosing path leading from the dosing system to the treatment chamber or a specific mixing compartment, where the dosing-amount of detergent is added to the washing liquor. Such dosing path may be implemented as a dosing channel connecting an outlet of the dosing system with the treatment chamber, for example. Then, the detection unit may be arranged in or adjacent to the dosing channel, depending on how the sensor unit is implemented.

According to a further embodiment, the detection unit includes a mechanical sensing unit, preferably a piezoelectric sensing unit, an optical sensing unit, an acoustic sensing unit and/or an electrical sensing unit.

The mechanical sensing unit is configured for detecting mechanical vibrations of coupled elements. Therefore, a strong coupling of the mechanical sensing unit to the element or area where mechanical vibrations are generated by the dosing-amount of detergent is preferred. For example, the mechanical sensing unit is incorporated into a deflecting element on which the dosing-amount of detergent falls after being dispensed and before reaching the washing liquor. Preferably, the mechanical sensing unit is arranged at a position outside of the treatment chamber, well protected from the harsh climatic conditions inside the treatment chamber. This has the advantage that the mechanical sensing unit has an extended service life and may have a relatively simple construction, and further a hole for guiding a power or signaling cable or the like for the mechanical sensing unit into the treatment chamber can be omitted. Therefore, the treatment chamber is less complex, because sealing means for sealing such hole are not necessary. Further, the mechanical sensing unit may only be pressed onto the coupled element, such that mechanical stresses of the coupled element, for example due to expansion or contraction with temperature changes, are not transferred on the mechanical sensing unit. This further increases service life of the mechanical sensing unit.

An optical sensing unit preferably comprises a light source, such as a laser and/or a light emitting diode, and a light detector, such as a photodiode. The light source and the light detector are arranged in one of several geometries, such that a transmitted light intensity, a reflected light intensity and/or a scattered light intensity of the dosing-amount of detergent is detected. The optical sensing unit may comprise more than one light source and/or light detector arranged in more than one of said geometries. Preferably, the light source is a spectral light source and/or the light detector is a spectral detector. The optical sensing unit may use light at other than visible wavelengths, in particular infrared light.

The acoustic sensing unit may be implemented as an ultrasonic sender-receiver arrangement which may detect a reflected ultrasonic sound intensity and/or a transmitted ultrasonic sound intensity. Further, the acoustic sensing unit may comprise a microphone configured for detecting a noise of the dosing-amount of detergent when hitting an element of the water-bearing household appliance.

The optical and/or acoustic sensing unit may also be implemented as a sensor barrier.

The electrical sensing unit may be implemented as a capacitance detector which detects a change of dielectric permeability of a surrounding volume or a inductive detector which detects a change of magnetic permeability of a surrounding volume.

According to a further embodiment, the water-bearing household-appliance further comprises a deflecting element arranged such that the dosing-amount of detergent hits the deflecting element after being dispensed and before being added to the washing liquor for generating a mechanical sensor signal.

In this embodiment, the detection unit is preferably implemented as a piezoelectric sensing unit for sensing the mechanical vibrations generated by the impact. Favorably, the piezoelectric sensing unit has a strong mechanically coupling with the deflecting element, for example it is arranged on a rear side of the deflecting element.

According to a further embodiment, the water bearing household-appliance, further comprises an analyzing unit for analyzing the detected sensor signal.

For example, the analyzing unit is implemented as a digital signal processor, a field programmable gate array, a microprocessor and/or a computer including dedicated resources such as RAM. Further, it may include a neural network that learns analyzing detected sensor signal and drawing conclusions over time and by itself. Preferably, the analyzing unit is a dedicated unit that serves only for the analysis of the detected sensor signal. In particular, the analyzing unit is configured for performing arithmetic operations, such as addition, multiplication as well as floating point operations and fast-fourier-transform operations with the detected sensor signals.

According to a further embodiment, the water-bearing household appliance comprises a setting element for setting one of a plurality of dosing paths for guiding the dispensed dosing-amount of detergent from the dosing system to the treatment chamber as a selected dosing path, and the control unit is implemented to select one of the plurality of dosing paths as a function of the detected sensor signal.

For example, the dosing channel described above forms the dosing path, wherein it comprises a first outlet leading to the treatment chamber and a second outlet leading to a mixing chamber for mixing a specific detergent with washing liquor. The setting element is implemented as a deflector that allows the dosing-amount of detergent to travel either one of the two dosing paths. In embodiments, a barrier for blocking the dosing channel such that the dosing-amount of detergent does not reach the washing liquor during the treatment cycle is also considered to be a dosing path.

It is understood that the examples and embodiments of the method may be adapted correspondingly to form embodiments of the water-bearing household appliance.

According to a further aspect, the invention relates to a computer program product comprising a program code for executing the above-described method for operating a water-bearing household appliance when run on at least one computer.

A computer program product, such as a computer program means, may be embodied as a memory card, USB stick, CD-ROM, DVD or as a file which may be downloaded from a server in a network. For example, such a file may be provided by transferring the file comprising the computer program product from a wireless communication network.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

Figure 2:
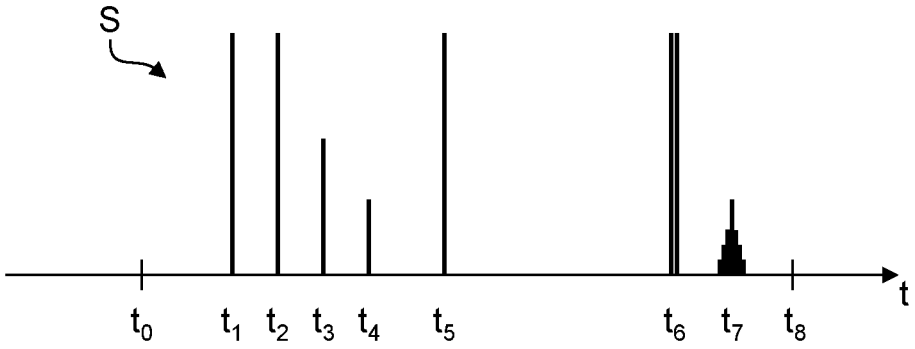
FIG. 2 shows an example of a detected sensor signal over the course of a treatment cycle.
Figure 3:
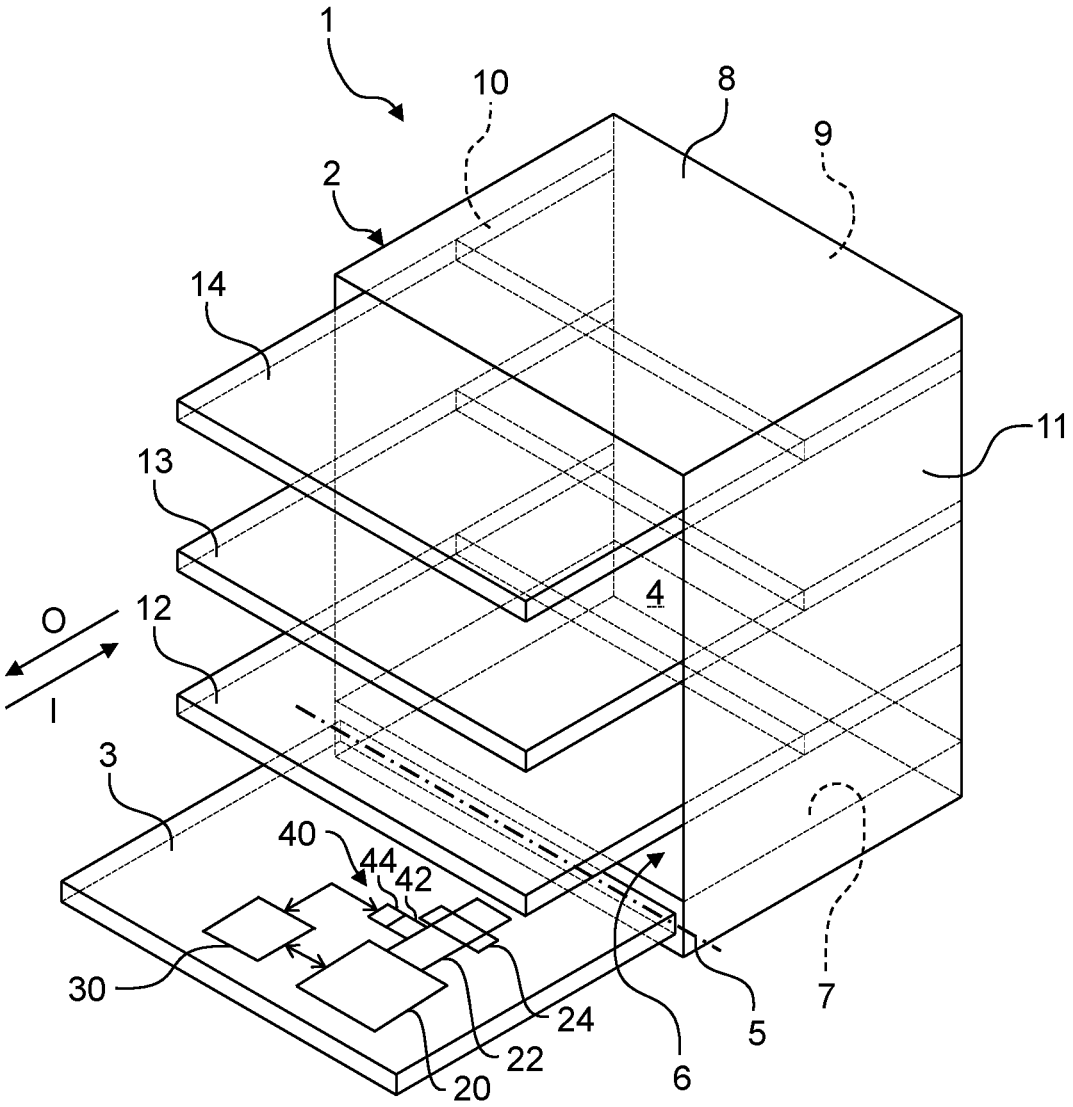
FIG. 3 shows an example of a water-bearing household appliance.

Further embodiments, features and advantages of the present invention will become apparent from the subsequent description and dependent claims, taken in conjunction with the accompanying drawings, in which:

FIG. 1 shows a block diagram of a first example of a method for operating a water-bearing household appliance;

FIG. 2 shows an example of a detected sensor signal over the course of a treatment cycle; and FIG. 3 shows an example of a water-bearing household appliance.

In the Figures, like reference numerals designate like or functionally equivalent elements, unless otherwise indicated.

FIG. 1 shows a block diagram of a first example of a method for operating a water-bearing household appliance 1 (see FIG. 3) for treating articles, which is embodied as a dishwasher for the purposes of this example. The dishwasher 1 comprises a treatment chamber 4 (see FIG. 3) for treating the articles with washing liquor and a dosing system 20 (see FIG. 3) for dispensing a dosing-amount of detergent provided by a dosing unit. The dosing system 20 is implemented as an automatic dosing system configured for dosing individual detergent tablets provided by the dosing unit, which comprises a storage cartridge for storing several hundreds of the detergent tablets.

In a first step S1, one of a plurality of different treatment cycles is selected. For example, the dishwasher 1 was loaded with heavily soiled dishes to be cleaned. The dishwasher 1 comprises means that detect the kind of dishware placed in the dishwasher 1 and the amount of soiling.

Accordingly, a control unit 30 (see FIG. 3) of the dishwasher 1 selects an "intensive" treatment cycle that is suited for heavily soiled dishes.

In a second step S2, the dishwasher 1 is controlled to perform the selected treatment cycle. For example, the "intensive" treatment cycle starts with two pre-rinsing steps, which are performed with fresh water as washing liquor without any detergent added to it. After this, a main cleaning step is intended to follow. At the beginning of the main cleaning step, a first amount of detergent is intended to be added to the washing liquor.

Thus, in a third step S3, the dosing system 20 is actuated to dispense the dosing-amount of detergent according to the selected treatment cycle. In this example, the intended dosing-amount of detergent corresponds to one detergent tablet, however deviations may occur due if the dosing system 20 has a malfunction.

In a fourth step S4, a sensor signal S (see FIG. 2) of the dispensed dosing-amount of detergent is detected. For example, the dishwasher 1 comprises a sensor unit 40 (see FIG. 3) with a detection unit 42 (see FIG. 3) implemented as a piezoelectric sensor implemented for detecting the impact of the dosing-amount of detergent after it is released from the dosing system 20 and hits an element of the dishwasher 1. The element may be section of a side wall or bottom of the dishwasher 1, a portion of a dosing channel 22 (see FIG. 3) or an element specifically designed for this purpose. The piezoelectric sensor 42 is implemented to detect the mechanical vibrations that originate from the impact. For this, the piezoelectric sensor 42 is preferably located close to the element and has a strong mechanical coupling to the element, which provides a good signal-to-noise ratio. However, the sensor signal S may be detected even if the piezoelectric sensor 42 is placed away from the element, as long as a mechanical coupling between the element and the piezoelectric sensor 42 exists.

Steps S3 and S4 may be repeated as often as desired in order to reach a first amount of detergent according to the selected treatment cycle. For example, the first amount of detergent may correspond to four of the detergent tablets. Then, the dosing system 20 needs to be actuated four times for dispensing one detergent tablet each time. Each time, the fourth step S4 is performed.

For example, a sensor signal S as shown in FIG. 2 is detected. The detected sensor signal S shows an amplitude of a mechanical vibration as detected by the piezoelectric sensor 42 as a function of the time t during the treatment cycle, starting from the beginning of the cleaning cycle t1. The detected sensor signal S shows two high peaks at timings t1 and t2 and two lower peaks at timings t3 and t4. The high peaks correspond to a signal generated when one detergent tablet hits the element. The lower peaks have a smaller amplitude. For example, the amplitude is proportional to the mass of the dosing-amount of detergent. Thus, in this case, it may be deduced that the dosing-amount of detergent was one detergent tablet on timing t1 and t2. The dosing-amount of detergent was two-thirds of a detergent tablet on timing t3 and it was one-third of a detergent tablet on timing t4. Therefore, a total amount of three detergent tablets was dispensed. That is, the amount added to the washing liquor is one detergent tablet short of the intended amount.

Therefore, in a fifth step S5, the selected treatment cycle is adjusted as a function of the detected sensor signal S. In the described example, a further dispense command is added to the treatment cycle to be performed on timing t5.

In a sixth step S6 the water-bearing household appliance 1 is controlled to perform the adjusted treatment cycle. In this example, this means that the dosing system 20 is actuated once more for dispensing a dosing-amount of detergent. The detected sensor signal S shows that the dosing-amount of detergent on timing t5 corresponds to a whole detergent tablet, because the peak is high.

At a later stage of the treatment cycle, at timings t6-t8 as shown in FIG. 2, it is intended to add an amount of detergent corresponding to three detergent tablets. At timing t6, the dosing system 20 is actuated and the sensor signal S of the dosing-amount of detergent is detected. Here, the dosing system 20 dispensed two detergent tablets instead of only one, which is evident from the two high peaks following closely in time. On timing t7, the dosing system 20 is actuated again to dispense one more detergent tablet. Here, the detected sensor signal S is not a single sharp peak, but a relatively wide distribution of a relatively low height. This kind of sensor signal S shows, for example, that a detergent tablet was crushed into several small pieces or fragments, including debris or powder, during the dispense event, resulting in a large number of smaller peaks over a short time period. Such signal may correspond to the dosing of detergent powder as well. In total, the dosing-amount of detergent amounts to one detergent tablet at timing t7, for example. Thus, the intended amount of three detergent tablets was dispensed already at timing t7. In order to prevent adding too much detergent, the control unit 30 adjusts the selected treatment cycle such that actuating the dosing system 20 at timing t8 is skipped.

The above example describes a relatively simple embodiment. It is noted that more complex embodiments may be employed, in particular concerning an analysis of the detected sensor signal S, and much more information about the dosing-amount of detergent may be obtained. For example, in the above embodiment, by analyzing a flank geometry of a rising flank of a peak may give information about the consistency of the dosing-amount of detergent.

Other embodiments involve other kinds of sensors and/or a combination of several different sensors. Different sensors may be sensitive for different information of the dosing-amount of detergent. For example, an infrared-sensor may sense a chemical composition of the dosing-amount of detergent. The skilled person will find the combination of sensors and combine them in one embodiment that is most suitable for a specific use-case.

FIG. 3 shows a schematic perspective view of an example of a water-bearing household-appliance 1 that is implemented as a domestic dishwasher in this example and is preferably operated according to the method as described with reference to FIG. 1. The domestic dishwasher 1 comprises a tub 2, which can be closed by a door 3. Preferably, the door 3 seals the tub 2 so that it is waterproof, for example by using a door seal between door 3 and the tub 2. Preferably, the tub 2 has a cuboid shape. Tub 2 and door 3 can form a treatment chamber 4 for washing dishes.

In FIG. 3, door 3 is shown in the open position. By swiveling about an axis 5 at a lower edge of door 3, the door 3 can be opened or closed. With the door 3, an opening 6 of the tub 2 for inserting dishes into the treatment chamber 4 can be opened or closed. Tub 2 comprises a lower cover 7, an upper cover 8 facing the lower cover 7, a rear cover 9 facing the closed door 3 and two side covers 10, 11 which face each other. For example, the lower cover 7, the upper cover 8, the rear cover 9 and the two side covers 10, 11 can be made from stainless steel sheets. Alternatively, at least one of the covers, for example the lower cover 7, can be made from a polymeric material, such as plastic.

The domestic dishwasher 1 further has at least one rack 12, 13, 14 on which dishes to be washed can be placed. Preferably, more than one rack 12, 13, 14 is used, wherein rack 12 can be lower rack, rack 13 can be an upper rack and rack 14 can be a rack specific for cutlery. As is shown in FIG. 3, the racks 12 to 14 are arranged vertically above each other in the tub 2. Each rack 12, 13, 14 can be pulled out from the tub 2 in a first direction O or pushed into the tub 2 in a second direction I.

FIG. 3 further shows a dosing system 20 that is implemented as an automatic dosing system here. The dosing system 20 is configured for being actuated by a control unit 30 such that a predefined amount of detergent is dispensed by the dosing system 20 and released into a dosing channel 22. The dosing channel 22 connects the dosing system 20 with the treatment chamber 4 and the dispensed dosing-amount of detergent has to pass through the dosing channel 22 to be added to washing liquor in the treatment chamber 4. The dosing channel 22 may be sealed by a barrier 24 such that the connection from between the dosing system 20 and the treatment chamber 4 is blocked.

A sensor unit 40 comprising a detection unit 42 for detecting a sensor signal and an integrated circuit 44 for shaping the detected sensor signal S (see FIG. 2) and outputting the detected sensor signal S to the control unit 30 is arranged adjacent to the dosing channel 22. In this example, the detection unit 42 is implemented as a piezoelectric element that is mechanically coupled to the dosing channel 22. Preferably, the detection unit 42 is arranged on an outer wall of a sheet of the door 3, in an area with stable climatic conditions and protected from the interior of the treatment chamber 4. The detection unit 42 may be attached loosely, such that mechanical deformations, for example due to temperature changes, do not affect the detection unit 42, but mechanical vibrations are still detected. This has the advantage that a service life of the detection unit 42 may be increased. When the dosing-amount of detergent is dispensed from the dosing system 20, it will fall into the dosing channel 22 (which will be in a perpendicular position when the door 3 is closed and the domestic dishwasher 1 is put as intended) driven by gravity, build up momentum and hit the barrier 24. By this impact, mechanical vibrations are generated, which are detected by the piezoelectric element 42 as the sensor signal S. The detected sensor signal S may be indicative of several parameters of the dosing-amount of detergent as described above.

It is noted that the piezoelectric element 42 can be very sensitive to mechanical vibrations. It may therefore be positioned away from the dosing channel 22 and still be capable of detecting the sensor signal S with a sufficient good signal-to-noise ratio. The sensor unit 40 may further comprise units for detecting noise, such that the signal-to-noise ratio of the detected sensor signal S may be enhanced, for example by the integrated circuit 44.

Although the present invention has been described in accordance with preferred embodiments, it is obvious for the person skilled in the art that modifications are possible in all embodiments.

REFERENCE NUMERALS

1 Water-bearing household appliance
2 Tub
3 Door
4 Treatment chamber
5 Axis
6 Opening
7 Lower cover
8 Top cover
9 Rear cover
10 Side cover
11 Side cover
12 Rack
13 Rack
14 Rack
20 Dosing system
22 Dosing channel
24 Barrier
30 Control unit
40 Sensor unit
42 Detection unit
44 Integrated circuit
I Push-in direction
O Pull-out direction
S Detected sensor signal
S1 Method step
S2 Method step
S3 Method step
S4 Method step
S5 Method step
S6 Method step
t Time
t0 Timing
t1 Timing
t2 Timing
t3 Timing
t4 Timing
t5 Timing
t6 Timing
t7 Timing
t8 Timing

The invention claimed is:

1. A method for operating a water-bearing household appliance for treating articles, the water-bearing household appliance comprising:

a treatment chamber for treating the articles with a washing liquor; and a dosing system for dispensing a dosing-amount of detergent provided by a dosing unit, the method comprising:

selecting one of a plurality of different treatment cycles, controlling the water-bearing household appliance to perform the selected treatment cycle;

actuating the dosing system to dispense the dosing-amount of detergent according to the selected treatment cycle, detecting a sensor signal generated by an impact of the dispensed dosing-amount of detergent after the dispensed dosing-amount of detergent is released from the dosing system, wherein the impact of the dispensed dosing-amount of detergent that generates the sensor signal is detected outside of the dosing unit, and wherein the sensor signal is a mechanical signal that is generated by an impact of the dosing-amount of detergent hitting a deflecting element after being dispensed and before being added to the washing liquor;

adjusting the selected treatment cycle as a function of the detected sensor signal; and controlling the water-bearing household appliance to perform the adjusted treatment cycle.

2. The method according to claim 1, wherein one or both the detected sensor signal and/or an analyzed sensor signal obtained by analyzing the detected sensor signal is compared with a pre-defined expected sensor signal and an error signal is generated as a function of a result of the comparison.

3. The method according to claim 2, wherein the pre-defined expected signal is one of a stored signal selected from a plurality of stored signals stored in a signal storage, a calculated signal calculated at a dispense-timing as a function of current operating parameters of the water-bearing household appliance or a determined signal determined from a plurality of historical detected sensor signals.

4. The method according to claim 1, wherein one of a plurality of dosing paths is selected as a function of the detected sensor signal, the analyzed sensor signal and/or the error signal and a setting element is set for routing the dosing-amount of detergent to the selected dosing path.

5. The method according to claim 1, further comprising:

digitizing the detected sensor signal, and processing the digitized sensor signal by means of digital signal processing techniques.

6. The method according to claim 1, wherein the step of adjusting the selected treatment cycle includes at least one of stopping the treatment cycle, shutting down the water-bearing household appliance, blocking the dispensed dosing-amount of detergent, selecting a different treatment cycle from the plurality and/or adjusting one or several parameters of the selected treatment cycle, in particular of a subsequent step of the selected treatment cycle.

7. The method according to claim 6, wherein adjusting one or several parameters of the selected treatment cycle includes at least one of adding a dispense command to the selected treatment cycle, adjusting a timing of a dispense command of the selected treatment cycle, adjusting a dosing-amount of detergent of a dispense command, adjusting a temperature profile of the washing liquor over the course of the selected treatment cycle, adjusting a volume of washing liquor of a sub-step of the selected treatment cycle and/or adjusting timings of a transition from a sub-step to a subsequent sub-step of the selected treatment cycle.

8. The method of claim 1, wherein the sensor signal is produced by a mechanical sensing unit within the treatment chamber or within a dosing channel that connects the dosing system to the treatment chamber.

9. The method of claim 1, wherein the sensor signal is produced by a piezoelectric sensing unit present within the treatment chamber of the water-bearing household appliance.

* * * * *